United States Patent [19]

McLean

[11] 4,005,590

[45] Feb. 1, 1977

[54] HANK DYEING

[75] Inventor: Nathan Cosh McLean, Shepshed, England

[73] Assignee: C.D.B. Europ, Villeneuve d'Ascq., France

[22] Filed: Apr. 15, 1975

[21] Appl. No.: 568,376

[52] U.S. Cl. ..... 68/5 D; 68/205 R; 118/324; 134/129

[51] Int. Cl.[2] ..... D06B 1/02

[58] Field of Search ..... 68/205 R, 5 D, 5 E, 68/189, 207; 118/314, 315, 323, 324; 134/72, 129; 198/189, 193, 194, 195

[56] References Cited

UNITED STATES PATENTS

| | | | |
|---|---|---|---|
| 2,218,811 | 10/1940 | Chaussabel | 68/205 R X |
| 2,619,306 | 11/1952 | Van Lake | 198/193 X |
| 2,728,238 | 12/1955 | Paasche | 118/323 X |
| 2,784,880 | 3/1957 | Pio | 198/193 X |
| 2,845,787 | 8/1958 | Fick | 68/189 |
| 3,172,777 | 3/1965 | Pano et al. | 118/324 X |
| 3,579,679 | 5/1971 | Willis | 68/205 R X |
| 3,688,530 | 9/1972 | Harris et al. | 68/205 R |
| 3,696,642 | 10/1972 | Rigacci | 68/205 R X |
| 3,698,214 | 10/1972 | Bahnsen | 68/205 R |
| 3,762,187 | 10/1973 | Fleissner et al. | 68/5 E |

*Primary Examiner*—Philip R. Coe
*Attorney, Agent, or Firm*—Larson, Taylor and Hinds

[57] ABSTRACT

A process of dyeing hanks and apparatus suitable for the process employs a longitudinally movable belt with longitudinally extending, transversely spaced support positions to carry a transversely arranged hank. A stream of highly fluid dye liquor is directed through nozzles onto the hank and soaks the hank locally. The dye is fixed, preferably by steaming, without disturbing the hanks after the permeation with dye liquor.

6 Claims, 6 Drawing Figures

HANK DYEING

The invention relates to processes and apparatus for dyeing which is especially suitable for producing space dyed yarns but which may also be used for other types of dyeing. The invention is particularly suitable for acrylic yarns.

BACKGROUND OF THE INVENTION

Space dyed yarns have been produced by applying different colours along the length of individual yarns. This method is expensive as the individual treatment of yarns is slow.

The Applicants have developed a process and apparatus for producing space dyed yarns by treating them in hank form. The technique superficially resembles that described in the British Patent Specification Nos. 250,899; 508,928; and 1,322,190. It is important however to realise that a dye liquor is employed and not a printing paste. The Applicants have overcome problems of production rates, definition of dye pattern and reproducibility which would arise with the prior art techniques and which make the prior art techniques unacceptable.

Objects of the invention are therefore to provide suitable apparatus for:

1. producing space dyed yarns at high production rates and at low cost;
2. achieving space dye effects on yarns using simple dye liquors;
3. achieving strictly local application of dye liquor and reducing the spreading of dye liquor away from the area where it was applied;
4. obtaining good reproducibility.

According to the invention there is provided apparatus for dyeing hanks which includes means for arranging dry hanks transversely on a longitudinally movable belt having transversely spaced longitudinally extending support positions; directing a narrow, continuous stream of dye liquor onto the hanks to permeate the part of the hank passing under the stream; and means for fixing the dye on the hanks.

The hanks should be dry to ensure that they absorb sufficient dye liquor and the yarns resist the passage of dye liquor only slightly. The dye liquor thus can pass through the thickness of the hank. The hank is supported by longitudinal extending transversely spaced belt parts which serve to reduce the passage of dye liquor in a transverse direction of the belt and along individual yarns. The dye liquor is applied as a continuous stream forming an uninterrupted "column" of liquor on impact with the yarn to facilitate penetration of the hanks and to reduce sideways spreading of dye liquor.

Preferably the stream is directed onto the hanks at a position between the longitudinally extending support positions of the belt. The dye liquor has a fluidity of water and is generally a dilute aqueous dyestuff solution. It contains no thickening agent. This is an important feature of the invention. This feature gives rise to the advantages of cost and speed but also makes techniques and apparatus suitable for printing or padding, inadequate in many respects in this case. Suitably the rate of delivery of dye liquor is adjustable so as to enable generally an amount of dye liquor required for permeating the appropriate part of the hank to be delivered. By appropriate adjustment waste of dye liquor can be avoided and reproducibility improved. This may also benefit pattern definition.

Advantageously a plurality of streams, at least some of which are formed by dye liquor, are directed to permeate together all of the hanks and to reduce transverse migration of dye liquor in the hanks and optionally at least some of the streams do not contain dye to provide blank areas in the hank. By wetting the whole of the hank, sideways spreading of dye liquor, due possibly to capillary action between adjacent yarns, can be reduced. Where areas are desired to be left uncoloured a stream of water not containing dye can be used.

Advantageously the permeation with dye-liquor is followed immediately by streaming so as to fix the dye and in which the belt supporting the hanks continues to carry the hanks into the steamer without any intermediate disturbance of the hanks. The dye-liquor does not adhere strongly to the yarn. By avoiding manipulation undesired displacement of dye liquor along the yarns or out of the hank can be avoided. This is important for reproducibility. For the same reason, suitably the hanks are arranged on the belt to provide a continuous layer of substantially constant thickness.

According to the invention there is also provided apparatus for dyeing which includes an endless longitudinal belt having transversely spaced longitudinally extending support positions; means for moving the belt, an array of nozzles for directing a narrow, continuous stream of dye liquor towards the belt; and means for fixing dye adjacent the array of nozzles. Suitably the nozzles are arranged to direct the streams between the longitudinally extending support positions to reduce sideways migration of dye liquor.

The longitudinally extending support positions may be formed by links — for example of stainless steel — pivotably connected to one another. A preferred form of belt construction is formed by transversely extending links of metal strip bent to provide a series of longitudinally extending edge portions which are hinged together. The area in contact with the hank and thereby also undesirable wetting and staining is reduced. Excess dye liquor can drain away with great facility. The belt surface does not resist the sliding of hank parts undergoing shrinkage. The belt resists deformation in a transverse direction and is capable of carrying a heavy layer of impregnated hanks. Advantageously the links are hinged together by a pivot rod extending through the longitudinally extending parts of the strips of successive links.

The nozzles may be mounted in a variety of ways. They may be mounted on one or more support bars above the belt. The nozzles can be used to eject differently composed liquors. For example sets of nozzles may be connected to a number of manifolds, one for each set, which in turn are connected to a supply of dye liquor. To facilitate pattern changes the nozzles may be mounted on clips. Suitably the height of the nozzles above the belt is adjustable and the rate of flow of dye liquor to the nozzles is adjustable. Advantageously the dye liquor is supplied to the nozzles from tanks by pumps, a by-pass fluid circuit is provided for each tank to enable pumped liquor to be returned to the tanks, and a flow control valve is provided between the pump and the nozzles. The dye liquor in the tanks can thus be stirred and flow can be adjusted simultaneously for all the nozzles supplied from a particular tank. Preferably a tray is provided under the belt below the array of nozzles for removing excess dye liquor.

Preferably the means for fixing dye is a steamer through which the belt extends and the steamer has an insulated heated roof, which is sloped; extraction flues adjacent the entry and exit to the steamer; and heating elements located between a steaming chamber of the steamer and the evacuation chambers. The steamer can thus be used with little or no condensation which could dislocate the dye liquor before the dye is fixed.

GENERAL

Figure 1:
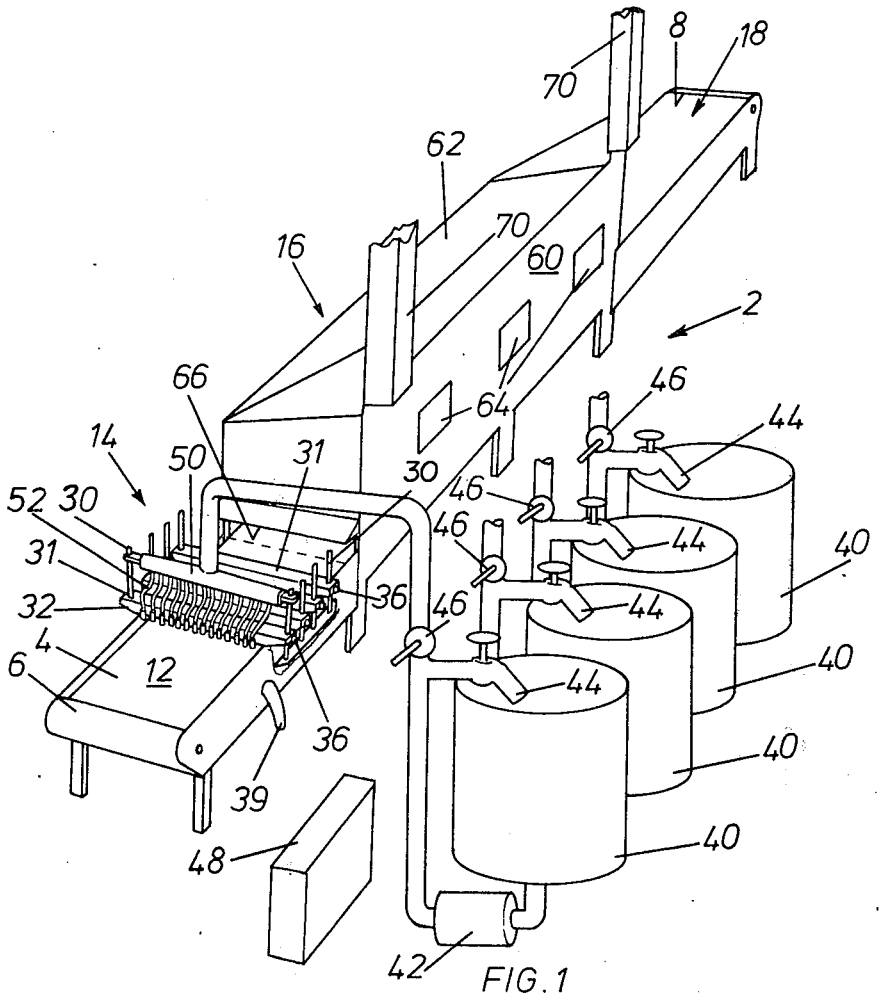
FIG. 1 shows a perspective view of a dyeing apparatus of the invention.

With reference to FIGS. 1 to 4, a dyeing apparatus 2 has an elongate transporter belt 4 supported at the front by an idle roller 6 and at the rear by drive sprockets 8. The belt 4 is supported at intermediate positions by jockey rollers 10. Along the belt 4, from front to rear, are successively positioned a loading station 12 for hanks, a dye liquor application station 14, a steamer 16, and an unloading station 18.

CONSTRUCTION AND SUPPORT OF THE BELT 4

The belt 4 (see particularly FIGS. 2 and 3) is formed by a plurality of interlinked, generally transversely extending, bent stainless steel strips 20. The strips 20 are bent in a zig-zag pattern to give short transverse portions 21*A* and long longitudinal portions 21*B*. The edges of the strips 20 remain in one plane and define the surface of the belt 4. Apertures are provided in the longitudinal portions adjacent the front of the bent strips 20. The apertures are transversely aligned. Similar apertures are also provided adjacent the rear. Successive strips 20 are interlinked by rods or pins 22 extending through the apertures at the front of one strip 20 and at the rear of another strip 20, the longitudinal portions overlapping. The strips 20 define at the surface of the belt 4 continuous longitudinally extending lines of support (23) which are spaced transversely by the short portions 21*A*.

At the unloading station 18, the belt 4 is supported at the sides by stationary guides 24. The belt 4 is guided at the idle roller 6 by flanges 26 on the side of the roller 6 and belt 4. A number of drive sprockets 8 is provided at the rear spaced evenly across the width of the belt and mounted on a common shaft. The sprockets 8 have teeth 28 for engaging in the apertures formed in the belt 4 between the longitudinal and transverse portions of successive strips 20. The belt 4 is driven by an electric motor (not shown) at a variable speed.

THE DYE LIQUOR APPLICATION STATION AND DYE LIQUOR SUPPLY CONSTRUCTION

Rods 30 are mounted upright on each side of the belt 4. Between each pair of rods 30 is mounted a bar 31 extending transversely across the belt 4. Nozzles 32 are releasably retained in clips 34 on the bars 31. The height of the nozzles 32 over the belt 4 is adjustable by knobs 36 which enable the bar 31 to be secured at different heights to the rods 30. The nozzles 32 are located so that liquid directed by the nozzles towards the belt 4 would pass between, and not onto, the long portions 21*B* of the strips 20. A drainage tray 38 is mounted between the upper and lower run of the belt 4 underneath the nozzles 32 for removing excess dye liquor. The liquor is removed from the tray 38 through a tube 39.

Figure 1A:
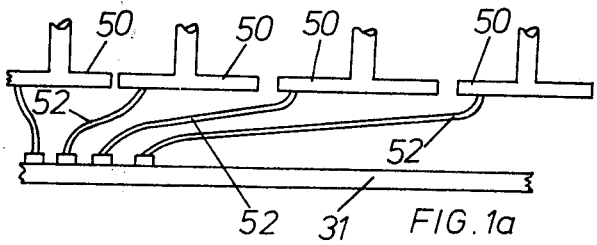
FIG. 1*a* shows schematically a modified manifold arrangement from that used in FIG. 1.
Figure 2A:
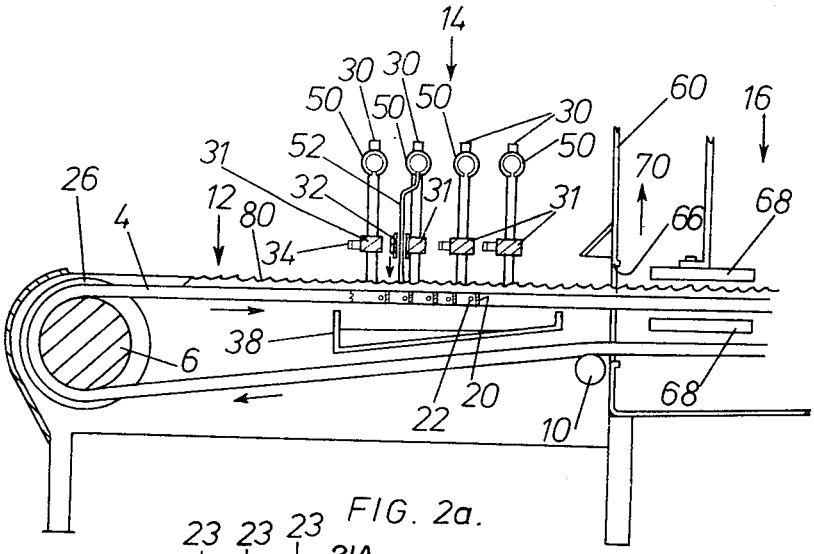
FIG. 2*a* shoWs a section along a longitudinal axis through the inlet side of the apparatus of FIG. 1.
Figure 3:
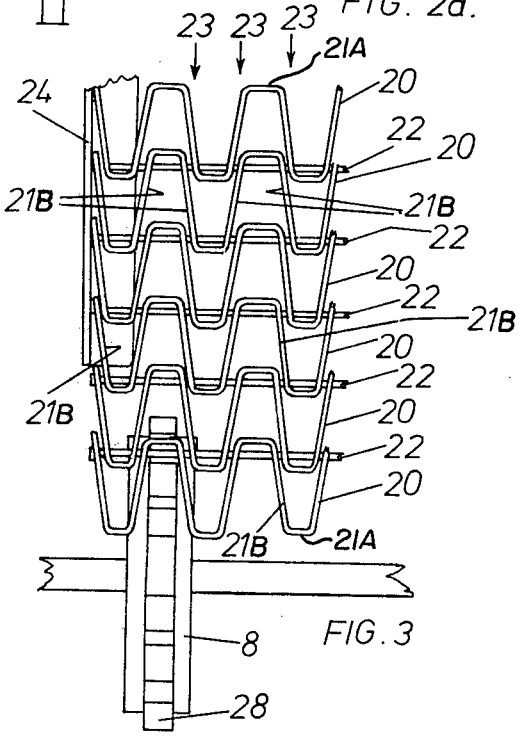
FIG. 3 shows a plan view of part of the outlet side of the apparatus of FIG. 1.
Figure 2B:
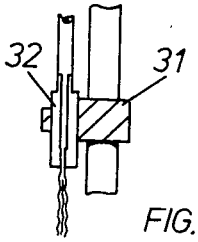
FIG. 2*b* shows a section of part of the dye nozzle arrangement of FIG. 2*a*.
Figure 4:
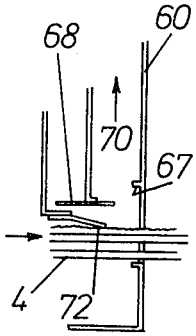
FIG. 4 shows a section through part of the outlet side of the apparatus of FIG. 1 along a longitudinal axis.

The dye liquor is held in large volume tanks 40 positioned next to the apparatus. Pumps 42 draw liquor from the tank toward a main supply pipe. A by-pass pipe 44 with a control valve enables excess liquor to be returned to the tank 40. A needle control valve 46 regulates the pressure in the main supply pipe and thereby the rate of flow. The pressure can be observed from control gauges on a panel 48. The main supply pipes lead to manifolds 50 one of which is shown in FIGS. 1 and 2 to be associated with each bar 31. Flexible tubes 52 interconnected the manifold with the individual nozzles. Alternative manifold arrangements are possible. FIG. 1*a* for example illustrates four manifolds 50 being associated with one bar 31.

CONSTRUCTION OF THE STEAMER

The steamer 16 has a housing 60 supported on legs. The housing 60 encloses an elongate steaming chamber operating at atmospheric pressure and has hatches 64 for access. The steaming chamber has a sloped roof 62. At the front end the housing 60 has an inlet 66 and at the rear end an outlet 67. The belt 4 passes into and out of the steamer 16 through the inlet 66 and outlet 67. Heated extraction flues 70 are provided over the inlet 66 and outlet 67 which are heated by flat panels 68. At the outlet 67 a rubber flap 72 is provided.

The steaming chamber is supplied with steam from a water bath extending underneath the belt which bath is heated indirectly by steam in coiled pipes at superatmospheric pressure. The panels 68 and the roof 62 are also indirectly heated with steam. The steamer is described in more detail in the Belgian Patent Specification 805,834 and corresponding other applications.

THE PROCESS

Dyestuff is dissolved in water in the tanks 40. Concentrations of a few grams per litre may be used. Additives to promote the dyeing process, such as acids, may be added. If necessary the dye liquor can be agitated and dissolution or dispersing assisted by the use of the by-pass pipes 44.

By adjusting the valves 46, dye liquor can be pumped at a controlled rate to the manifolds 50. Where only a small number of nozzles require dye liquor from one tank, the rate of flow from that tank may be correspondingly reduced so that the rate of flow at each nozzle is similar. Operatives can satisfy themselves by observing the gauge on the panel 48 that the flow rate through the needle valves 46 is correct. A typical rate of flow could correspond to a pressure of 2 kg per sq cm in the main supply pipe.

The manifold arrangement of FIG. 1 employs a greater number of nozzles than that in FIG. 1*a* and is capable of, say, covering 80% of the hank width in one colour and the remainder in three other colours.

The required pattern can be obtained by inactivating certain nozzles 32 and placing active nozzle 32 in the appropriate clips 34. Care should be taken to avoid overlap or untreated areas. If necessary one tank 40 may be fitted with water to soak those areas of the hank which are to remain undyed. The bars are arranged using the knobs 36 at a suitable height, clear of the hanks which pass underneath but not so high that the jet of water breaks up into droplets before reaching the hanks.

Operatives place dry hanks 80 onto the belt 4 at the loading station 12. They should endeavour to arrange the hanks 80 in a layer of even thickness along the length of the belt 4 (see FIG. 2). Dye liquor from the nozzles 32 impinges on hanks 80, and penetrates rapidly through the hanks in a downward direction. By adjusting the amount of dye liquor emerging from the nozzle 32 and belt speed, enough dye can be applied to soak the hanks from top to bottom leaving little or nothing in excess. This also reduces the time during which an area of the hank is exposed to the jet of dye liquor to a minimum and reduces sideways spreading of dye liquor along the yarns of the hanks 80.

The hanks 80 are supported mainly by the longitudinally extending portions 21*B* of the strips 20, arranged spaced apart (by 0.5 inch approximately) on either side of the area onto which the jet of dye liquor is directed. The weight of the hank portion soaked with dye liquor causes the hanks 80 to sag between the longitudinally extending portions 21*B* and so reduces any sideways flow of dye liquor away from the hank area exposed to the jet. The belt 4 is strong enough to hold the hanks overall in a horizontal attitude. Wetting of the hanks 80 by the belt 4 is small and, if it occurs, takes place only in areas of the hank to the side of areas which are primarily to absorb the dye liquor. Any excess of dye liquor can drain promptly away from the hanks 80. Drained dye liquor is gathered and removed by the tray and tube 39.

The hanks 80 to which dye liquor has been applied, are then moved into the steamer 16 without any movement which might cause the dye liquor to be squeezed out or otherwise transported. The steamer 16 is adapted with a view to reducing condensation which might locally rinse the dye liquor from the hanks 80. The inlet 66 is heated and the extraction flue 70 provides an upward draft of air and steam (dry steam). Apart from preventing condensation and cooling of the inlet 60, loss of steam from inside the steaming chamber may be avoided, volatile vapours do not intrude into the working atmosphere and the hank may be slightly preheated. Condensation on the roof 62 of the steamer may be reduced by insulation and a heating installation in the roof.

Condensation is counteracted at the outlet 67 in a similar manner as at the inlet 66. During steaming hanks, especially certain types of acrylic fibres, may shrink considerably. The belt 4 permits shrinkage to take place without major disturbance of the hanks 80 or the belt 4.

The hanks may be removed at the unloading station 18 and then rinsed and dried. The method may be used to dye acrylic fibres with basic dyestuffs. Adequate fixation can be obtained by steam at atmospheric pressure.

Many different patterns can be produced to give spaced dyed yarns which can be knitted or woven to give random speckled effects. Some slight spreading of dye liquor sideways takes place giving a wider dyed area at the bottom than at the top of the layer of hanks. This improves the random effect. The apparatus and method may also be used to dye hanks in one colour or to dye other absorbent substrates. substrates.

I claim:

1. Dyeing apparatus comprising:

A. yarn conveying means comprising a longitudinally extending endless support having a plurality of longitudinally extending support elements for yarns arranged transversely across the support, the support elements being spaced transversely with respect to the endless support to permit dye liquor to pass between the support elements, and means for guiding and driving the support elements along an endless path;

B. dye liquor application means comprising a plurality of arrays of nozzles for expelling dye liquor under pressure, means for fixedly mounting the nozzles with respect to the longitudinal extent of said endless path and means for adjustably mounting the nozzles heightwise with respect to said endless path to permit dye liquor to be expelled by the nozzles from a predetermined controllable height towards said endless support; a set of tubes for individually supplying dye liquor to the nozzles in each array, a respective manifold means for supplying liquor to each set of tubes collectively, a respective conduit pipe for supplying dye liquor to each manifold means, a respective pressure control means for controlling dye liquor flow through each conduit pipe a plurality of pumps and a plurality of dye liquor tanks, one tank being associated with one of the pumps, one of the pressure control means, one of the conduit pipes and one of the manifold means to permit one pressure control means to control the flow of dye liquor through all of the tubes of a set of tubes simultaneously; and C. means mounted along the endless support downstream of the arrays of nozzles for fixation of the dye in the dye liquor.

2. Dyeing apparatus as claimed in claim 1 wherein the support elements are pivotably interconnected links and said longitudinally extending support elements are defined by said links arranged lengthwise one behind the other to thereby define a support comprising a plurality of endless longitudinally extending zones of support, and wherein the nozzles have outlet apertures for directing dye liquor between adjacent ones of said zones.

3. Dyeing apparatus as claimed in claim 1 wherein said means mounting the nozzles includes means for releasably securing the individual tubes in an array of nozzles in a variety of different transversely spaced positions with respect to said longitudinally extending endless support.

4. Dyeing apparatus as claimed in claim 1 in which each pressure control means includes an adjustable flow control valve for restricting the flow of dye liquor through a respective conduit pipe to a respective manifold means and a by-pass conduit for returning dye-liquor in excess of that supplied to the respective manifold means to the respective tank.

5. Dyeing apparatus as claimed in claim 1 wherein the dye fixation means comprises a steamer having a heated insulated roof to prevent condensation falling on the yarn.

6. Dyeing apparatus as claimed in claim 1 wherein the means for guiding and driving the support elements include a pair of rollers for holding an upper stretch of the endless support suspended between them and the arrays of nozzles are secured by said mounting means over the suspended part.

* * * * *